US007751768B2

(12) United States Patent
Yamada

(10) Patent No.: US 7,751,768 B2
(45) Date of Patent: Jul. 6, 2010

(54) FIXING DEVICE AND IMAGE FORMING APPARATUS INCLUDING FIXING DEVICE

(75) Inventor: Masamichi Yamada, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 460 days.

(21) Appl. No.: 11/862,634

(22) Filed: Sep. 27, 2007

(65) Prior Publication Data

US 2008/0080909 A1 Apr. 3, 2008

(30) Foreign Application Priority Data

Sep. 28, 2006 (JP) ..... 2006-264685

(51) Int. Cl.
*G03G 15/20* (2006.01)

(52) U.S. Cl. ..... 399/323; 399/322

(58) Field of Classification Search ..... 399/322–323
See application file for complete search history.

(56) References Cited

U.S. PATENT DOCUMENTS

| | | | | |
|---|---|---|---|---|
| 5,241,354 | A * | 8/1993 | Flynn | 399/323 |
| 6,088,558 | A | 7/2000 | Yamada et al. | |
| 6,091,926 | A | 7/2000 | Yamada | |
| 6,351,619 | B1 | 2/2002 | Yamada | |
| 6,553,204 | B1 | 4/2003 | Yamada | |
| 6,577,840 | B2 | 6/2003 | Hachisuka et al. | |
| 6,795,676 | B2 * | 9/2004 | Kikuchi et al. | 399/323 |
| 6,925,280 | B2 | 8/2005 | Yamada | |
| 7,228,096 | B2 | 6/2007 | Yamada | |
| 2002/0176726 | A1 * | 11/2002 | Ohuchi et al. | 399/323 |
| 2003/0081970 | A1 * | 5/2003 | Yamamoto et al. | 399/323 |
| 2004/0146323 | A1 * | 7/2004 | Fujisawa et al. | 399/323 |
| 2005/0220506 | A1 * | 10/2005 | Nakayama | 399/323 |
| 2006/0045590 | A1 | 3/2006 | Yamada | |

FOREIGN PATENT DOCUMENTS

| | | |
|---|---|---|
| JP | 3-75462 | 7/1991 |

(Continued)

OTHER PUBLICATIONS

English Abstract of JP 2001083832 A to Uehara et al.*

(Continued)

*Primary Examiner*—David M Gray
*Assistant Examiner*—Ryan D Walsh
(74) *Attorney, Agent, or Firm*—Oblon, Spivak, McClelland, Maier & Neustadt, L.L.P.

(57) ABSTRACT

A fixing device includes a fixing member, a pressure member and a separation mechanism. The pressure member presses against the fixing member to form a nip through which a toner image on a recording medium is fixed. The separation mechanism is disposed at a downstream side from the nip to separate the recording medium from the fixing member. The separation mechanism includes a separation plate and a gap control member. The separation plate opposed to the fixing member with a gap therebetween includes a metal base member and a resin tip member. The gap control member controlling the gap by contacting the fixing member includes a curved tip having a radius of not greater than 0.6 mm. A center of the curved tip and a tip of the resin tip member are congruent with each other in a direction perpendicular to a feed direction of the recording medium.

10 Claims, 10 Drawing Sheets

FOREIGN PATENT DOCUMENTS

| | | | |
|---|---|---|---|
| JP | 2001-83832 | | 3/2001 |
| JP | 2001083832 | A * | 3/2001 |
| JP | 2003-107947 | | 4/2003 |
| JP | 2003-122171 | | 4/2003 |
| JP | 2003-202767 | | 7/2003 |
| JP | 2005173447 | A * | 6/2005 |
| JP | 2006-11193 | | 1/2006 |

OTHER PUBLICATIONS

English Abstract of JP 2005173447 A to Iwatani et al.*

* cited by examiner

FIXING DEVICE AND IMAGE FORMING APPARATUS INCLUDING FIXING DEVICE

CROSS-REFERENCE TO RELATED APPLICATION

This patent specification is based on Japanese Patent Application No. 2006-264685 filed on Sep. 28, 2006 in the Japan Patent Office, the entire contents of which are incorporated by reference herein.

BACKGROUND

1. Field of the Invention

Exemplary aspects of the present invention relate to a fixing device, and more particularly, to a fixing device for use in an image forming apparatus such as a copier, printer or facsimile.

2. Description of the Related Art

A related art image forming apparatus generally includes a fixing device fixing a toner image on a recoding medium such as transfer sheets. The fixing device includes a fixing member (e.g., a fixing roller and a fixing belt) and a pressing member (e.g., a pressure roller and a pressing belt). In the course of a fixing process, for example, the pressing member is heated and is pressed against the fixing member to form a nip therebetween. When a recording medium passes through the nip, a toner image carried thereon is fused, thereby fixing the toner image thereon. The toner generally includes resin and is fused in the nip. Since the toner has a property of adhering to the fixing member when fusing, for example, a releasing agent such as wax is added thereto, and/or the surface of the fixing member is coated with a releasing agent (e.g., silicone oil) so that the toner is unlikely to adhere to the fixing member.

Such a fixing member includes a related-art separation mechanism in the vicinity thereof. The related-art separation mechanism includes a separation tab to forcibly separate the recording medium, which is adhered to the fixing member due to the fused toner image, from the fixing member.

In this regard, the separation tab of the related-art separation mechanism slides in contact with the fixing member, and therefore the toner tends to accumulate on the separation tab. The accumulated toner soils the recording medium. In addition, a sliding mark can be generated on the fixing member. The sliding mark not only shortens the life of the fixing member but also produces an abnormal image on the recording medium.

Recently, the surface of the fixing member is rarely coated with a releasing agent due to handling difficulty, resulting in increasing the likelihood of generating the accumulated toner problem and the sliding mark problem. Therefore, a variety of proposals have been made in attempting to solve the above-described problems.

One example attempts to use a separation plate (referred to as a non-contact separation plate) separating a recording medium from a fixing member without being contacted therewith.

Another example attempts to use a separation guide member (referred to as a non-contact separation guide member) that is integrally formed of synthetic resin and separates a recording medium from a rotation member acting as a fixing member without being contacted therewith. In this example, the edge of the separation guide member is positioned based on the position of a bearing of the rotation member. Specifically, a support member supporting the separation guide member abuts the bearing to position the separation guiding member with respect to the rotation member.

In addition to solving the above-described problems, a fixing device of recent years is expected to have reduced size and greater serviceability. In such a fixing device, a fixing roller including an elastic member such as sponge members made of silicone foam is used to increase the degree of contact with a pressure roller, thereby increasing a nip width to meet such recent demand. The fixing roller including such sponge member can also reduce start-up time and electric power consumption of the fixing device.

However, the fixing roller with such sponge member (e.g., the silicone foam) has a short life due to the increased degree of contact with the pressure roller. In attempting to solve this problem, a release mechanism is disposed to release the pressure of the pressure roller against the fixing roller, for example, when the fixing process ends and the fixing device is not in operation.

In the above-mentioned fixing devices, the pressure roller contacts the fixing roller in a nip. In other words, the pressure roller digs slightly into the fixing roller in the nip when pressure is applied from the pressure roller to the fixing roller. When the release mechanism releases the pressure of the pressure roller, the fixing roller is released from such pressure and the surface thereof returns to an initial state. In the course of such pressure release, the surface of the fixing roller expands.

When the surface of the fixing roller expands, a non-contact separation member such as the non-contact separation plate and the non-contact separation guiding member above can damage the surface of the fixing roller. In order to avoid this problem, the edge of non-contact separation member has to be set to a position at which the edge is not contacted with the fixing member even when the surface of the fixing member expands. In this case, however, the separation member does not have good separability.

In the first-mentioned example, the non-contact separation plate includes an abutting member to control a gap between an edge thereof and a fixing member (i.e., a rotation member). Such an abutting member needs to have a thickness of at least 1 mm. Consequently, the distance between a point at which the abutting member contacts the fixing member and the edge of the separation plate should be long (about 6 mm) when the edge of the separation plate is disposed in an immediate vicinity of a downstream side from a nip formed between the fixing member and a pressing member.

In this regard, the edge of the separation plate cannot respond well to the expansion of the surface of the fixing member, thereby increasing the risk of damaging the surface thereof. In addition, the gap cannot be reduced to a desirable level.

In the second-mentioned example, the edge of the non-contact separation guiding member having a specific curvature radius is positioned based on the position of the bearing of the rotation member (i.e., the fixing member). Consequently, the edge of the non-contact separation guiding member cannot respond to the expansion of a surface of the rotation member in an immediate vicinity of a downstream side from a nip formed between the rotation member and a pressing member. Further, it is relatively difficult to position the edge of the separation guiding member in the immediate vicinity of the downstream side from the nip in which the surface of the rotation member can expand due to pressure applied from the pressing member. Therefore, the gap between the edge of the separation guiding member and the surface of the rotation member cannot be reduced to a desirable level.

SUMMARY

According to one aspect of the invention, a fixing device includes a fixing member, a pressure member, and a separation mechanism.

The pressure member presses against the fixing member to form a nip through which a sheet of a recording medium having a toner image is fed to fix the toner image thereon.

The separation mechanism is disposed at a downstream side from the nip relative to a sheet feed direction of the sheet of the recording medium so as to separate the recording medium from the fixing member. The separation mechanism includes a separation plate and a gap control member. The separation plate is opposed to the fixing member with a gap therebetween in a sheet feed area and includes a metal base member and a resin tip member mounted on a tip of the metal base member. The gap control member controls the gap by contacting the fixing member in a sheet non-feed area and includes a curved tip having a radius of not greater than 0.6 mm. A center of the curved tip and a tip of the resin tip member are substantially congruent with each other in a direction perpendicular to the sheet feed direction.

BRIEF DESCRIPTION OF THE DRAWINGS

A more complete appreciation of the exemplary aspects of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1A:
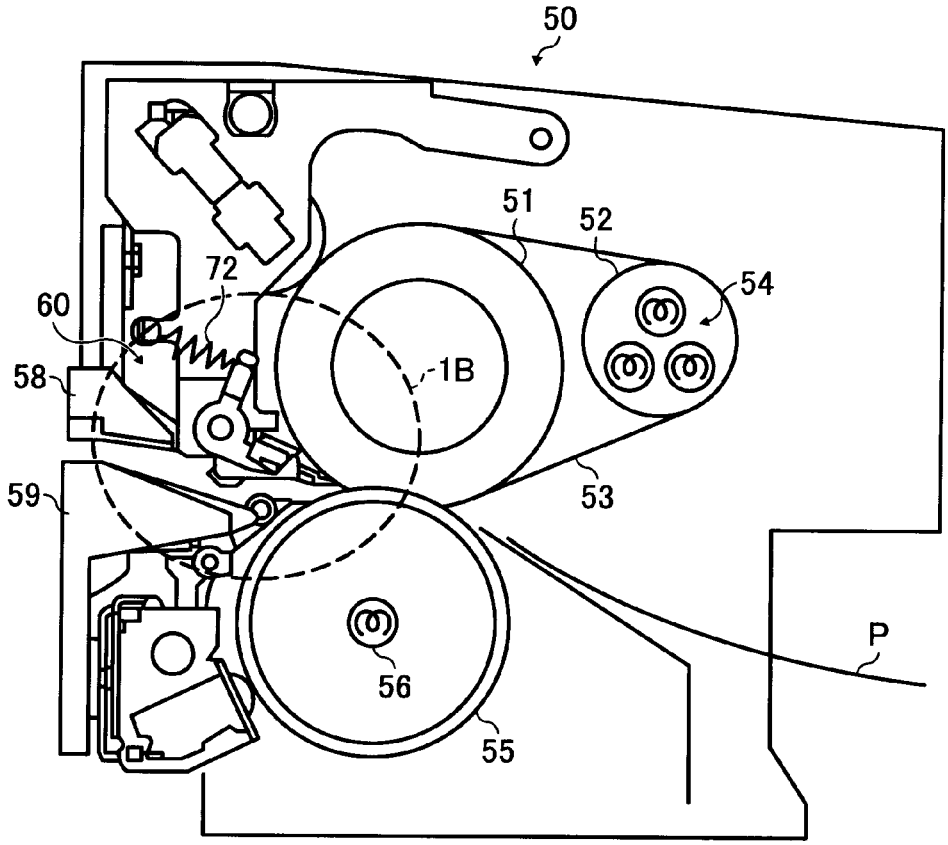
FIG. 1A is a schematic view illustrating a fixing device including a separation mechanism according to an exemplary embodiment of the present invention.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or a feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Referring now to the drawings, wherein like reference numerals designate identical or corresponding parts throughout the several views, a fixing device according to an exemplary embodiment of the present invention is described.

Referring to FIG. 1A, a fixing device 50 includes a fixing roller 51, a heating roller 52, a pressure roller 55, a fixing belt 53, a fixing side guide plate 58, a pressing side guide plate 59, a recording medium P, and a separation mechanism 60.

The fixing roller 51 acting as a fixing member used for fixing a toner image on the recording medium P. The heating roller 52 includes a first halogen heater 54 therein to heat the fixing belt 53. The pressure roller 55 presses against the fixing roller 51 with the fixing belt 53 therebetween, thereby forming a nip area therebetween. The pressure roller 55 includes a second halogen heater 56 to heat thereof. The fixing belt 53 also acting as the fixing member is an endless belt tightly stretched by the fixing roller 51 and the heating roller 52. The fixing side guide plate 58 and the pressing side guide plate 59 guide the recording medium P to a latter stage of the fixing process. The recording medium P is, for example, a transfer sheet on which the toner image is formed. The separation mechanism 60 separates the recording medium P from the fixing member.

As shown in FIG. 1A, the recording medium P with an unfixed toner image thereon is fed from a right side to the nip area in which heat and pressure are applied to the unfixed toner image, thereby forming a fixed toner image thereon.

The fixing belt 53 has an internal diameter of 60 mm (when stretched in a circle) and includes a base having a first layer and an outmost layer. The base includes a polyimide resin with a thickness of 90 μm. The first layer of the base member is made of silicone rubber having a thickness of 200 μm, and the outmost layer thereof is made of a tetrafluoroethylene-perfluoroalkyl vinyl ether copolymer (PFA) having a thickness of 20 μm.

The fixing roller 51 has an external diameter of 52 mm and includes a core therein. The core has thereon a heat-resistant elastic layer made of silicone rubber having a thickness of 14 mm. The heating roller 52 is an aluminum hollow circular cylinder with a thickness of 1 mm and has a diameter of 30 mm. The first and second halogen heaters 54 and 56 are heat sources.

The pressure roller 55 has an external diameter of 50 mm and includes an iron hollow core and an outmost layer. The iron hollow core has a thickness of 1 mm and is covered with silicone rubber having a thickness of 1.5 mm. The outmost layer has a tube made of a tetrafluoroethylene-perfluoroalkyl vinyl ether copolymer.

The pressure roller 55 digs slightly into the fixing roller 51 in a digging amount of 3 mm. In other words, the pressure roller 55 presses against the fixing roller 51 in the digging amount of 3 mm with the fixing belt 53 therebetween. The pressure roller 55 and the fixing roller 51 form the nip area therebetween. The nip area has a width of 14 mm (i.e., the length of the nip area in a sheet conveyance direction is 14 mm) and a separation tab 57 described later is arranged at a downstream side therefrom relative to the sheet conveyance direction. The description of the dotted circle portion of FIG. 1A including the separation mechanism 60 will be given with reference to FIG. 1B.

Figure 1B:
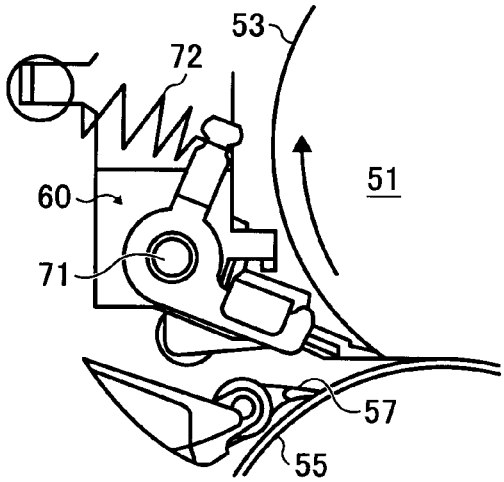
FIG. 1B is a schematic enlarged view illustrating the separation mechanism of FIG. 1A.

FIG. 1B is schematic enlarged view illustrating the separation mechanism 60 and the separation tab 57 disposed at a downstream side from the nip area of FIG. 1A. The separation tab 57 separates the recording medium P from the pressure roller 55 and slides in contact with the pressure roller 55.

The separation mechanism 60 separates the recording medium P from the fixing belt 53. The separation mechanism 60 is disposed at the downstream side from the nip area and includes a spring 72. A fulcrum 71 acts as a pivot of the separation mechanism 60 so that the separation mechanism 60 can swing. The spring 72 extends between one end of the separation mechanism 60 and a frame of the fixing device 50. Therefore, the one end of the separation mechanism 60 is biased counterclockwise by the spring 72, while another end of the separation mechanism 60 is biased in a direction towards the fixing belt 53.

According to the exemplary embodiment, the separation mechanism 60 is disposed downstream from the nip area in a fixing member (roller) side, while the separation tab 57 is disposed downstream from the nip area in a pressing member (roller) side. For example, when the recording medium P passes through the nip area, the separation mechanism 60 and the separation tab 57 separate the recording medium P from the fixing belt 53 and the pressure roller 55, respectively. Subsequently, the fixing side guide plate 58 and the pressing side guide plate 59 guide the recording medium P to the latter stage of the fixing device 50. A further description of the separation mechanism 60 will be given with reference to FIG. 2A though FIG. 5B.

Figure 2A:
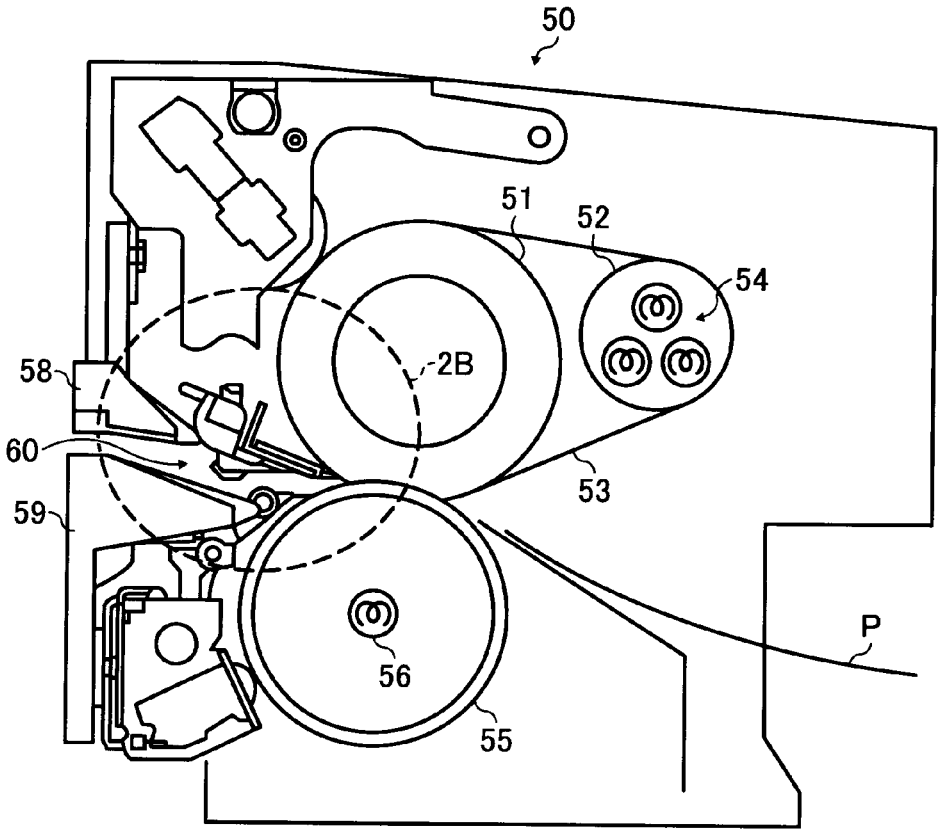
FIG. 2A is another schematic view illustrating main elements of the fixing device of FIG. 1A.

FIG. 2A illustrates main elements of the fixing device 50 of FIG. 1A. The fixing device 50 illustrated in FIG. 2A is similar to the fixing device illustrated in FIG. 1A, except for the spring 72 and the member at which the spring 72 is hooked are omitted. Since the reference numbers used in FIG. 1A and FIG. 2A designate corresponding parts, descriptions thereof will be omitted. The description of the dotted circle portion of FIG. 2A including the separation mechanism 60 will be given with reference to FIG. 2B.

Figure 2B:
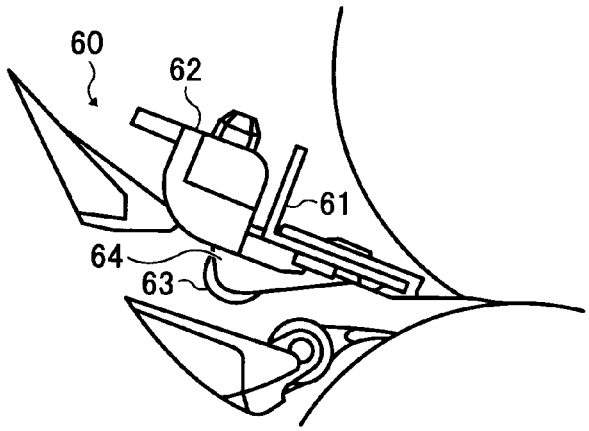
FIG. 2B is a schematic enlarged view illustrating main elements of the separation mechanism of FIG. 2A.

Referring to FIG. 2B, the separation mechanism 60 of FIG. 2A is enlarged to illustrate main elements thereof. The separation mechanism 60 includes a separation plate 61, a separation plate support member 62, a roller 63, and a guide member 64.

The separation plate 61 is used for separating the recording medium P from the fixing belt 53. The separation plate 61 is mounted on the separation plate support member 62. The roller 63 is a rotation member. The guide member 64 guides the recording medium P from an end of the separation plate 61 to the roller 63. The separation plate 61 and the separation plate support member 62 are described in detail with reference to FIG. 3A.

Figure 3A:
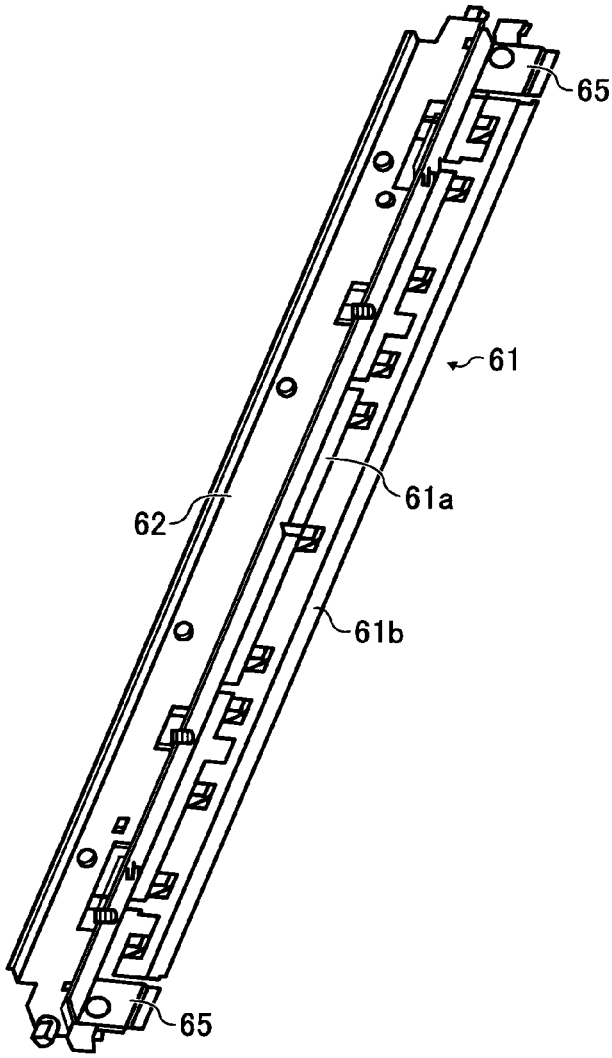
FIG. 3A is a schematic perspective view illustrating a separation plate with a separation plate support member.

Referring to FIG. 3A, the separation plate 61 is mounted on the separation plate support member 62 and includes a tip member 61*b* and a base member 61*a*. The tip member 61*b* includes a plurality of positioning members 65 at both ends thereof (i.e., sheet non-feed areas). Each of the positioning members 65 is secured to the base member 61*a* by a screw. The separation plate 61 and one of the positioning members 65 are described in detail with reference to FIG. 3B.

Figure 3B:
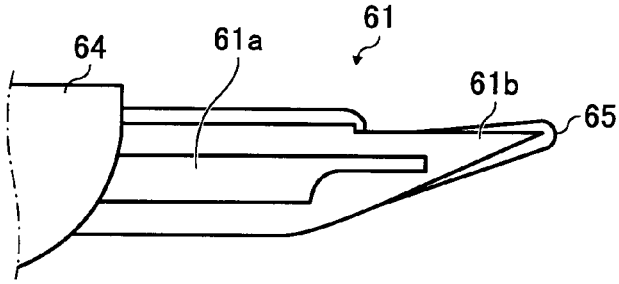
FIG. 3B is a schematic enlarged view illustrating the separation plate of FIG. 3A and an end vicinity thereof.

FIG. 3B is a schematic enlarged view illustrating the separation plate 61 and the end vicinity thereof. As shown in FIG. 3B, the positioning member 65 as representative of the positioning members 65 is disposed at one side of the tip member 61*b* of the separation plate 61. The tip member 61*b* has a thin sharp tip. The positioning member 65 has a curved tip with an appropriate thickness and acts as a gap control member for controlling a distance (i.e., a gap) between the tip member 61*b* and the fixing belt 53. The thin sharp tip of the tip member 61*b* and a center of the curved tip of the positioning member 65 are disposed in such a manner as to be substantially congruent with each other in an axial direction of the fixing roller 51 (i.e., in a direction perpendicular to a sheet feed direction).

Figure 4:
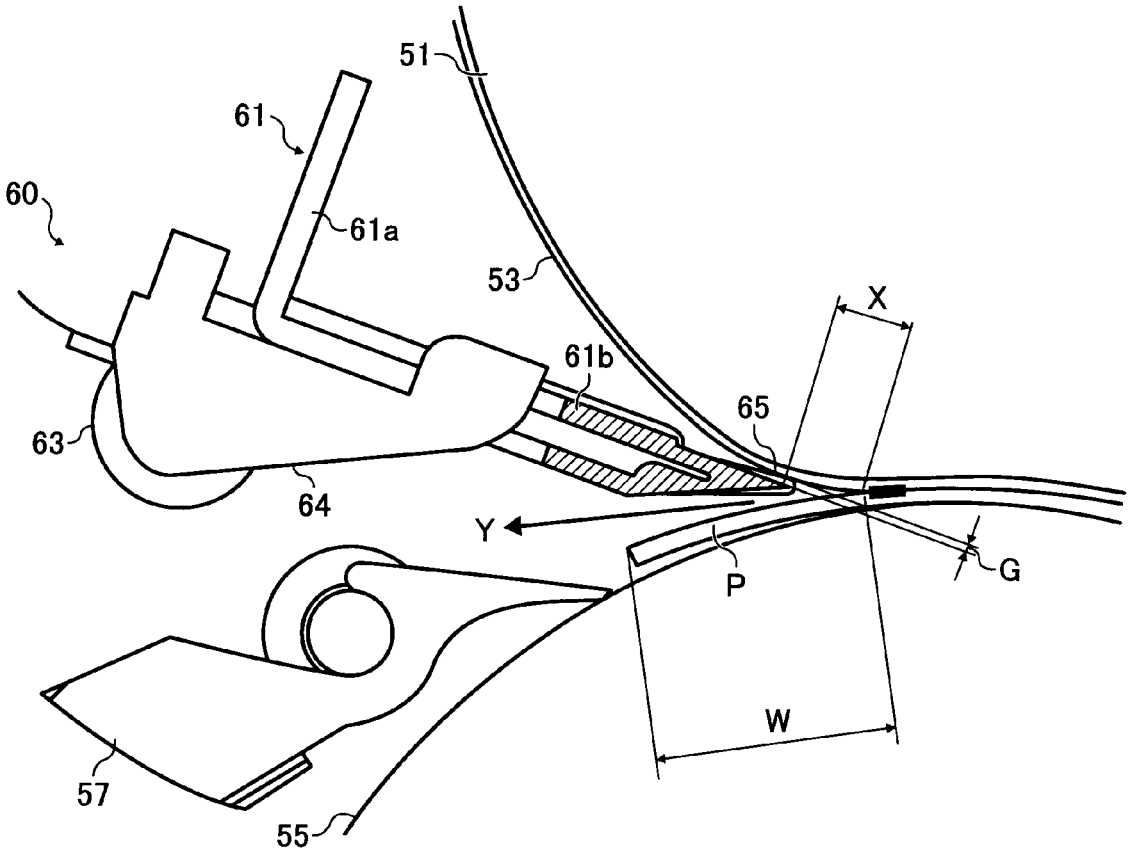
FIG. 4 is a schematic view illustrating a relationship between the separation plate of FIG. 3B and the fixing belt of FIG. 1A.

Referring to FIG. 4, it can be seen that the separation plate 61 and the fixing belt 53 are disposed at the downstream side from the nip area. The positioning member 65 illustrated in FIG. 4 is representative of the plurality of positioning members 65. Descriptions of elements in FIG. 4 that have already been described with respect to FIG. 1A through FIG. 3B are omitted as redundant.

The separation member 65 is disposed at each side of the tip member 61*b* in a sheet non-feed area. When the end vicinity of the separation plate 61 is biased by the spring 72 towards the fixing belt 53, the positioning member 65 contacts a surface of the fixing belt 53 while the tip member 61*b* in a sheet feed area is unlikely to contact the fixing belt 53. Therefore, the tip member 61*b* and the fixing belt 53 have a gap G therebetween in the sheet feed area.

The tip member 61*b* of the separation plate 61 is preferably disposed as close as possible to the fixing belt 53 on the downstream side from the nip area so that the separation mechanism 60 can obtain good separability. A distance between a downmoststream point of the nip area and the tip member 61*b* is X as shown in FIG. 4. The recording medium P has a blank space (margin) W in the leading end thereof, determined by mechanical specifications of an image forming apparatus. The nip area has an exit having a tangent line vector Y. The distance X needs to be shorter than the blank space W and the tip member 61*b* needs to be positioned on a side close to the fixing belt 53 relative to the tangent line vector Y so that the separation mechanism 60 can obtain good separability.

In general, a recording medium has a blank of 1 to 5 mm in the leading end thereof, and the gap between a tip member is 0.1 to 0.6 mm to secure good separability. Therefore, in the exemplary embodiment, the curved tip of the positioning member 65 has a radius of not greater than 0.6 mm.

Therefore, the gap G between the tip member 61*b* and the fixing belt 53 can be small, for example, 0.6 mm or less. The tip member 61*b* can be disposed in the immediate vicinity of the downstream side of the nip area so that the distance X between the nip downmoststream point and the tip member 61*b* can be shorter than the blank space W of the recording medium P. The separation plate 61 can be disposed in such a manner as to be on the side near the fixing belt 53 relative to the tangent line vector Y as shown in FIG. 4.

According to the exemplary embodiment, the non-contact separation mechanism 60 can have separability that is substantially the same as or better than that of a contact separation mechanism having a separation tab that contacts a fixing member. Since the separation mechanism 60 does not slide in contact with the fixing belt 53 in the sheet feed area, a sliding mark is unlikely to be generated thereon. Therefore, the separation mechanism 60 can reduce a frequency of abnormal images caused by the sliding mark on the recording medium P.

More specifically, a related-art separation mechanism includes a separation tab sliding in contact with a fixing member in a sheet feed area, resulting in accumulation of the toner between a tip member and a fixing belt. However, according to the exemplary embodiment, the separation mechanism 60, which is disposed at a location downstream from the nip area and closer to the fixing member, can reduce toner accumulation between the tip member 61*b* and the fixing belt 53.

Among the elements of the separation mechanism 60, the positioning members 65 slide in contact with the fixing belt 53 and have the shortest life-span. According to the exemplary embodiment, the positioning members 65 are configured to be individual elements. In other words, each of the positioning members 65 can be replaced with a new one during a maintenance, and the running cost of the separation mechanism 60 can be reduced.

At the same time, toner accumulation and the abnormal image are unlikely to occur on the pressing member side, which does not contact an unfixed toner image (i.e., non-image forming side). Therefore, the pressure roller 55 can employ a contact separation tab as the separation tab 57 for the pressing member side.

Figure 5A:
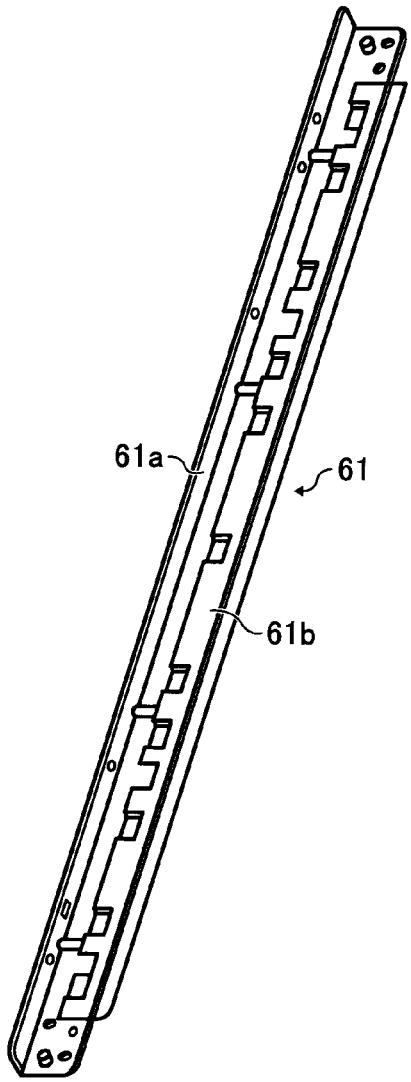
FIG. 5A is another schematic perspective view illustrating the separation plate.

Referring to FIG. 5A, the separation plate 61 is illustrated. The base member 61*a* includes a sheet metal. The tip member 61*b* includes a fluorine resin. A further description thereof will be given with reference to FIG. 5B.

Figure 5B:
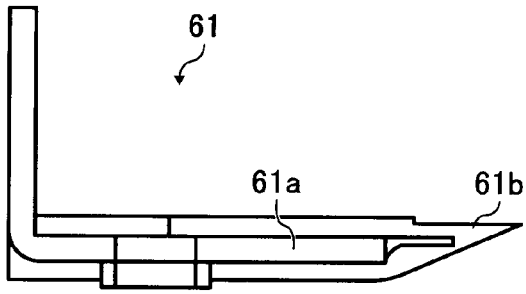
FIG. 5B is a schematic side view illustrating the separation plate of FIG. 5A.

FIG. 5B is a schematic enlarged view illustrating the separation plate 61 including the base member 61*a* and the tip member 61*b*. The base member 61*a* has a thin tip that is drawn by rolling, thereby extending to the end the separation plate 61. The tip member 61*b* is integrated to the base member 61*a* by outsert molding.

Therefore, the base member 61*a* can be disposed in the end of the separation plate 61. Since the steel metal base member 61*a* is integrated with the resin tip member 61*b*, the end of the separation plate 61 can be molded accurately. Since the tip member 61*b* includes a resin, the tip thereof can be molded so as to have a thickness of 0.2 mm or below or a curvature of 0.1 mm or below. Therefore, the tip member 61*b* can obtain a relatively high separability with respect to the recording medium P.

Unlike a metal tip member, which generates scratches and causes dew condensation, the resin tip member 61*b* can reduce the occurrence of scratches on the toner image and abnormal images caused by dew condensation.

Figure 6A:
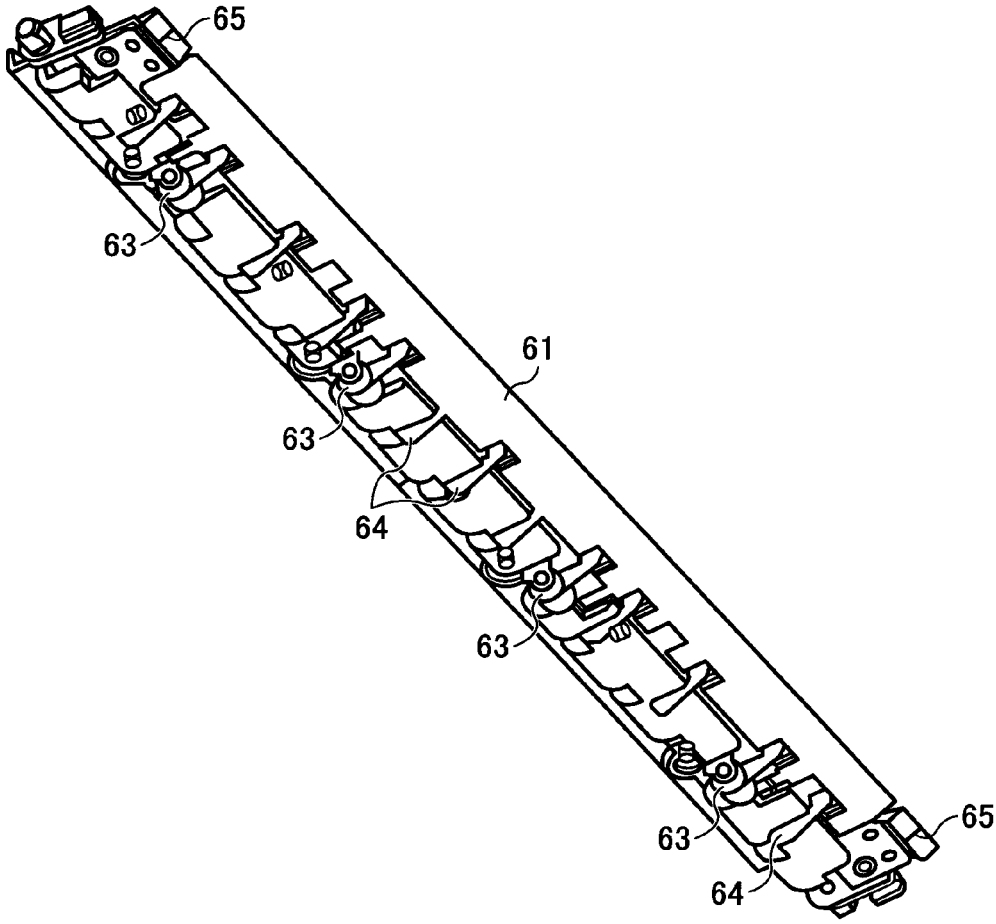
FIG. 6A is a schematic perspective view illustrating the separation mechanism of FIG. 1 as seen from a transfer sheet side.
Figure 6B:
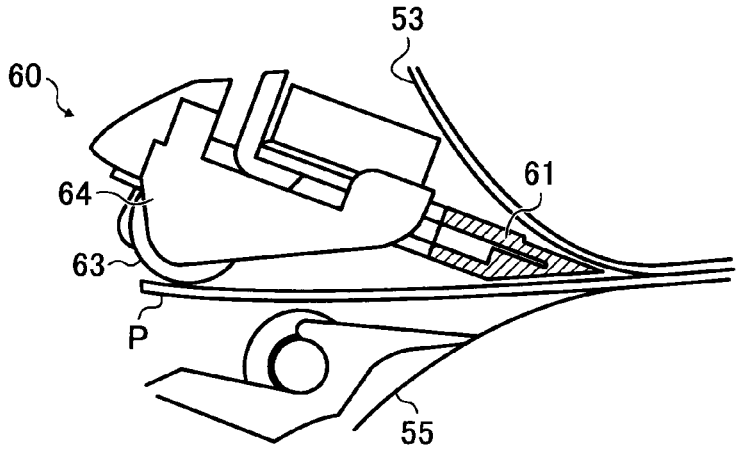
FIG. 6B is a schematic side view illustrating the separation mechanism of FIG. 6A and the vicinity thereof.

Referring to FIG. 6A and FIG. 6B, the separation mechanism 60 is observed from the bottom (i.e., a sheet feed side) and side thereof, respectively.

As shown in FIG. 6B, the roller 63 is disposed at the downstream side from the separation plate 61 and is rotatable. The roller 63 is rotatably driven by conveyance of the recording medium P. The guide member 64 is disposed to guide the recording medium P from the end of the separation plate 61 to the roller 63.

The tip member 61*b* separates the recording medium P from the fixing belt 53. The guide member 64 and the roller 63 convey the recording medium P without contacting the separation plate 61. In other words, the guide member 64 and the roller 63 can reduce the occurrence of abnormal images such as smudged images caused by sliding in contact the recording medium P with the separation plate 61 after separation of the recording medium P from the fixing belt 53.

For example, if the guide member 64 and the roller 63 are not provided, the recording medium P is conveyed while sliding in contact with the separation plate 61. In other words, the recording medium P can generate a sliding mark, a smudged image, etc. thereon. However, in the exemplary embodiment, the recording medium P is conveyed by the guide member 64 and the roller 63 without sliding in contact with the separation plate 61, thereby reducing the occurrence of smudged images, sliding marks, and the like. In addition, the guide member 64 and the roller 63 are integrated with the separation plate 61, and the positional relationships thereof remain constant, thereby not only reducing smudged images, sliding marks, etc., but also increasing a likelihood of maintaining conveyance quality at a consistent level.

Figure 7A:
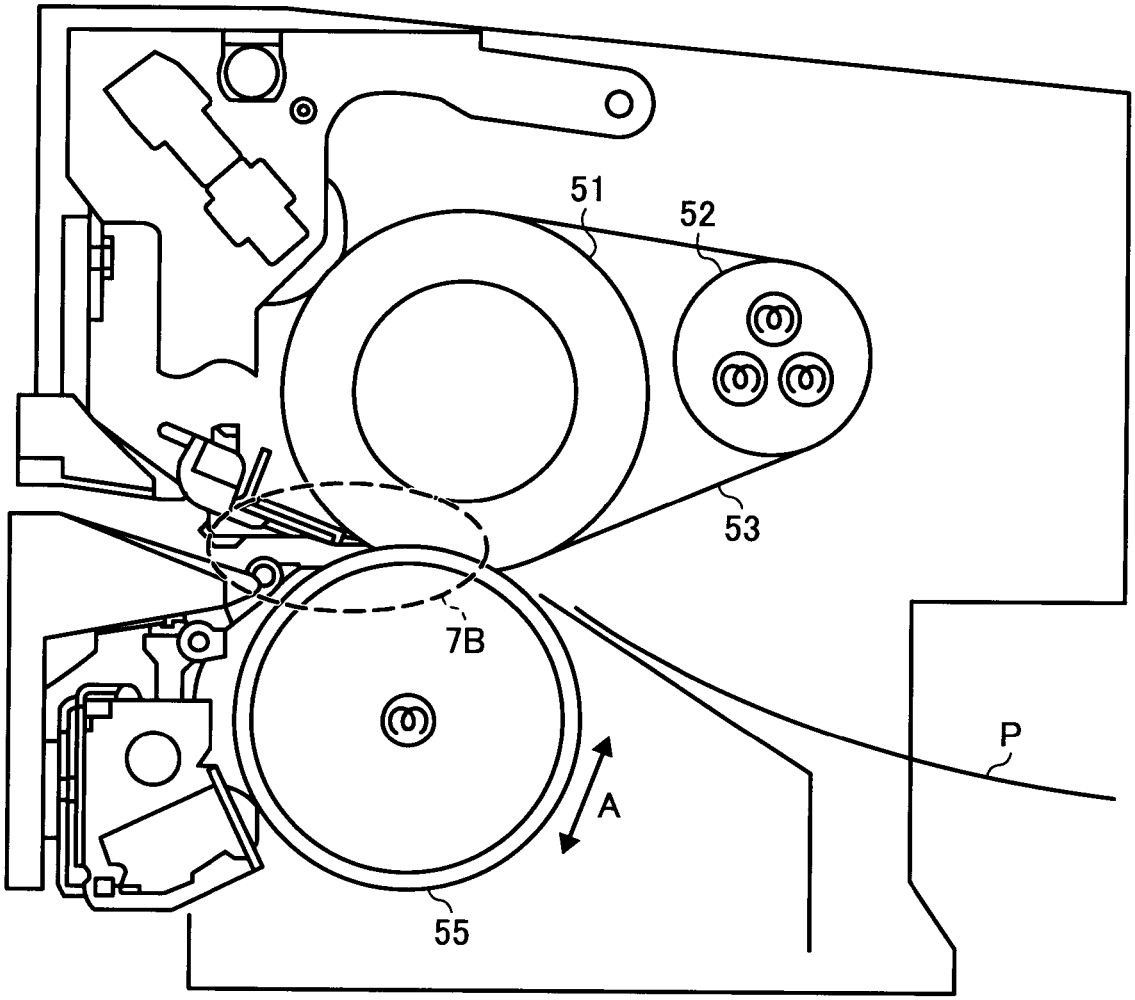
FIG. 7A is another schematic view illustrating main elements of the fixing device of FIG. 1A.

Referring to FIG. 7A, the fixing device 50 is shown to explain situations in which the pressure roller 55 applies and releases pressure thereto and therefrom. The fixing device 50 of FIG. 7A is similar to the fixing device of FIG. 2A, except that a direction in which the pressure roller 55 can move, described later, is indicated by arrow A. Since the reference numbers used in FIG. 2A and FIG. 7A designate corresponding parts, descriptions thereof will be omitted. The dotted circle portion of FIG. 7A including the separation mechanism 60 are described with reference to FIG. 7B and FIG. 7C.

Figure 7B:
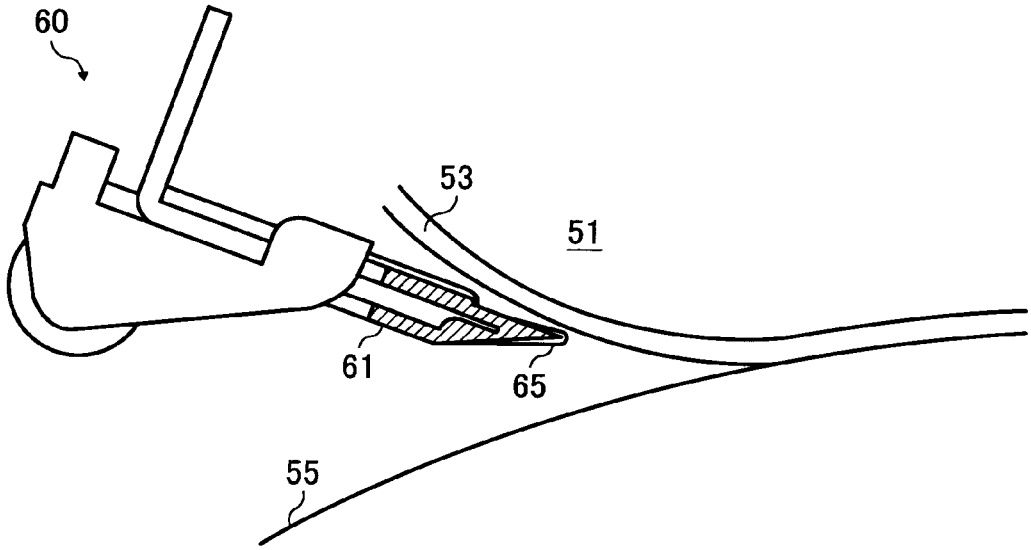
FIG. 7B is a schematic enlarged view illustrating the separation mechanism when pressure is applied.
Figure 7C:
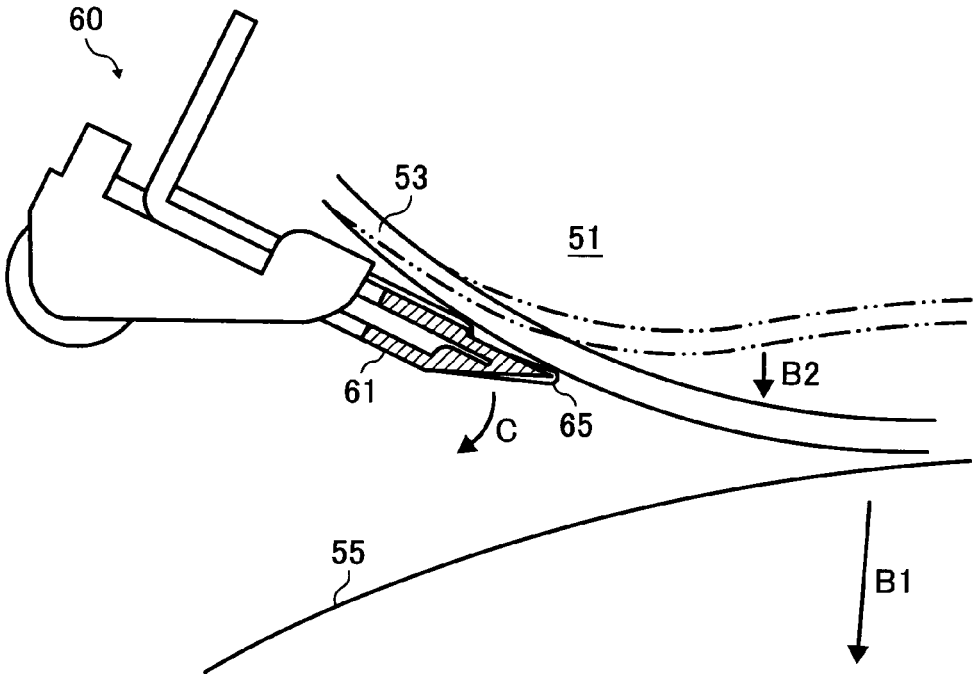
FIG. 7C is a schematic enlarged view illustrating the separation mechanism when the pressure is released.

FIG. 7B and FIG. 7C illustrate enlarged views of the separation mechanism 60 when the pressure roller 55 applies and releases pressure, respectively.

The separation mechanism 60 includes the fixing roller 51 having an elastic layer with foamed silicone. Since the pressure roller 55 presses against the fixing roller 51 in the digging amount of 3 mm to form the nip area therebetween, it is necessary to solve the problems of permanent compression distortion and reduced life-span of the fixing roller 51.

According to the exemplary embodiment, the pressure roller 55 is configured to release the pressure thereof by using a release mechanism, not shown, that may be an ordinary pressure-release mechanism having a pressure lever. A further description of the release mechanism is omitted. The pressure roller 55 is movable in the direction A as shown in FIG. 7A so that the pressure is applied to and released from the fixing roller 51 and the fixing belt 53.

The separation mechanism 60 includes the separation plate 61 in the position described with reference to FIG. 4 so as to obtain good separability thereof in a non-contact manner. Arranging the separation plate 61 at that position enhances the separability of the separation mechanism 60 to a desired level when pressure is applied in the course of the fixing process. When pressure is released by the release mechanism, the pressure roller 55 moves in a direction indicated by arrow B1 shown in FIG. 7C, thereby relieving the distortion of the fixing roller 51. Subsequently, the fixing belt 53 moves in a direction indicated by arrow B2 shown in FIG. 7C, thereby moving the surface thereof in the end vicinity of the separation plate 61. For example, the surface of fixing belt 53 moves to a position at which the end of the separation plate 61 is positioned when pressured is substantially applied.

In addition, when the fixing belt 53 moves in the direction of arrow B2 and pushes the end vicinity of the separation plate 61, the separation mechanism 60 swings in a direction indicated by arrow C shown in FIG. 7C. The separation mechanism 60 can follow the surface movement of the fixing belt 53. The separation mechanism 60 swings while being pushed by the fixing belt 53 through the positioning member 65. Therefore, the end of the separation plate 61 of the separation mechanism 60 can reduce an occurrence of damaging the surface of the fixing belt 53.

Figure 8A:
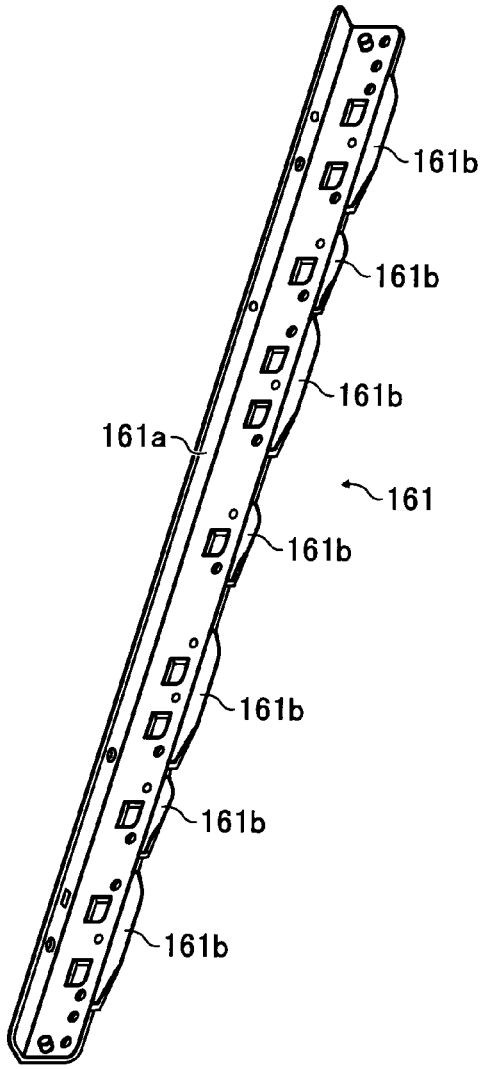
FIG. 8A is a schematic perspective view illustrating a variation of the separation plate of FIG. 5A.
Figure 8B:
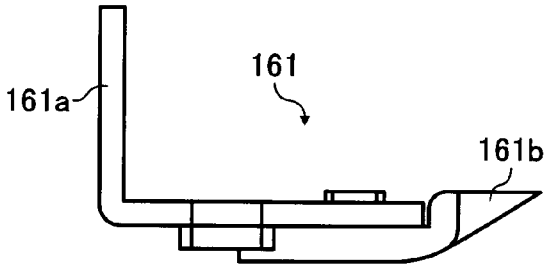
FIG. 8B is a schematic side view illustrating the separation plate of FIG. 8A.

FIG. 8A and FIG. 8B are a schematic diagram and a side view, respectively, illustrating a second separation plate 161 that is a variation of the separation plate 61. The second separation plate 161 of FIG. 8A and FIG. 8B is similar to the separation plate 61 of FIG. 5A and FIG. 5B and includes a second base member 161*a* and seven second tip members 161*b* that are similar to the base member 61*a* and the tip member 61*b*, respectively.

Like the base member 61*a* and the tip member 61*b* of FIG. 5A and FIG. 5B, the second base member 161*a* includes a sheet metal, and the second tip members 61*b* include a fluorine resin. The seven second tip members 161*b* are mounted and secured to the second base member 161*a* by swaging. The second base member 161*a* is secured to the positioning member 65 of FIG. 5A by screws at both sides of second tip member 161*b*. The second tip member 161*b* can be adhesively mounted on the second base member 161*a*.

The second separation plate 161 can enhance a position accuracy of an end thereof by accurately molding each of the second tip members 161*b* and securing each thereof with the second base member 161*a*. Since the second tip members 161*b* include resin, the tip thereof can be molded so as to have a thickness of 0.2 mm or below or a curvature of 0.1 mm or below. Therefore, the second tip member 161*b* can obtain relatively high separability with respect to the recording medium P. The separation plate 61 can be replaced by the second separation plate 161.

Figure 9:
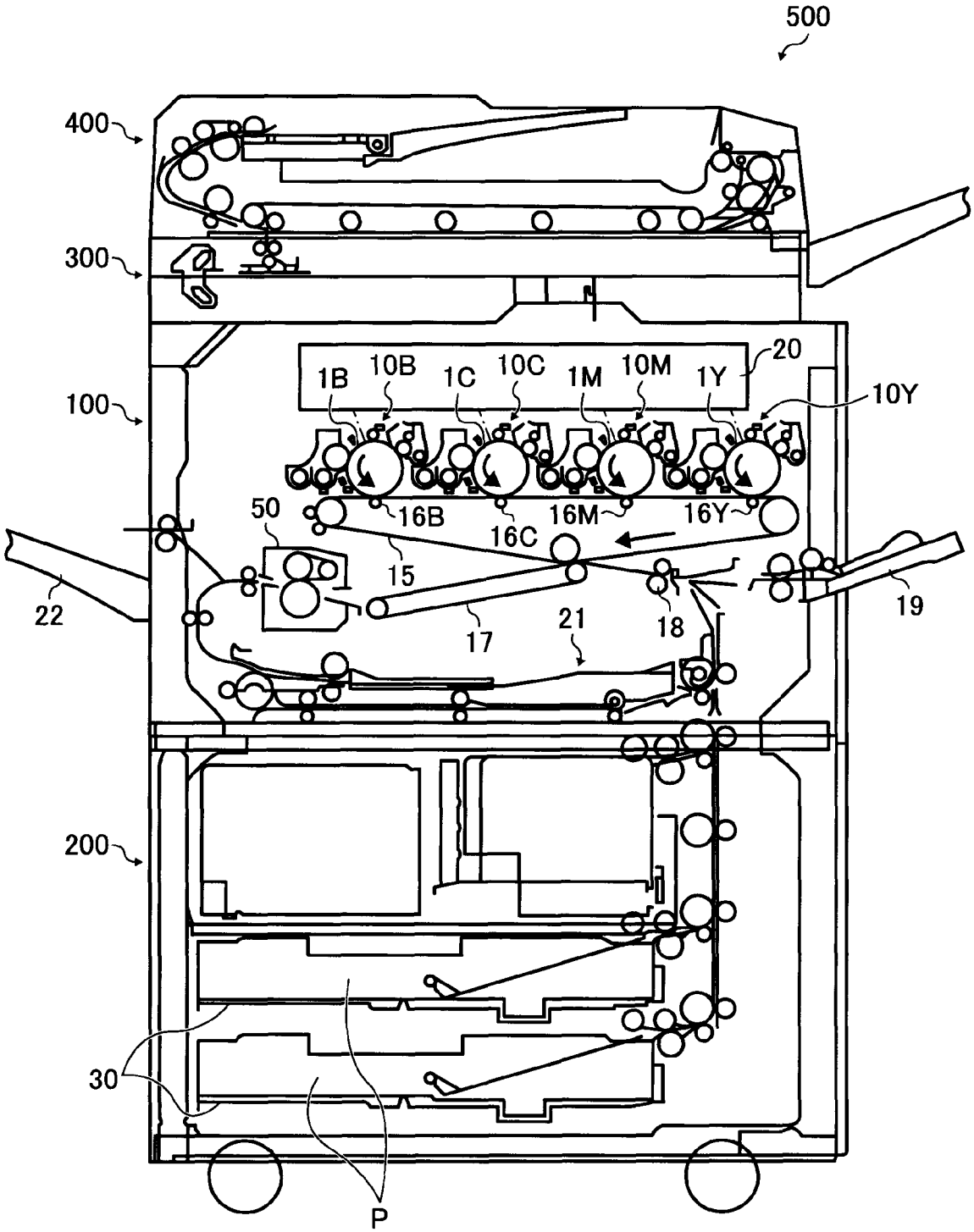
FIG. 9 is schematic diagram illustrating an image forming apparatus including the fixing device of FIG. 1A.

Referring to FIG. 9, an image forming apparatus 500 is illustrated with the fixing device 50 according to the exemplary embodiment. The image forming apparatus 500 includes a copier 100, a sheet feed unit 200, a scanner 300, and an automatic document feed device 400.

The copier 100 includes four image forming units 10B, 10C, 10M and 10Y, an intermediate transfer belt 15, an exposure device 20, a secondary transfer device 17, a reversing device 21, registration rollers 18, a manual feed tray 19, an ejection tray 22, and the fixing device 50. The reference numerals with the abbreviations B, C, M and Y represent four color components, black, cyan, magenta, and yellow, respectively.

The four image forming units 10B, 10C, 10M and 10Y of the copier 100 respectively include photoconductors 1B, 1C, 1M and 1Y acting as latent image carriers. For example, one of the photoconductors 1B as representative of the photoconductor drums 1B, 1C, 1M and 1Y includes a charging device (not shown), a developer (not shown), a cleaning device (not shown), and a discharge device (not shown), and a primary transfer device 16B in the vicinity thereof. Therefore, each of the four image forming units 10B, 10C, 10M and 10Y forms and develops an electrostatic latent image to form a toner image.

The photoconductors 1B, 1C, 1M and 1Y form electrostatic latent images thereon by scanning light applied by the exposure device 20. The primary transfer devices 16B, 16C, 16M and 16Y transfer the toner images on the respective photoconductors 1B, 1C, 1M and 1Y onto the intermediate transfer belt 15. The exposure device 20 irradiates surfaces of the photoconductors 1B, 1C, 1M and 1Y with laser lights to form the electrostatic latent image thereon. The intermediate transfer belt 15 is an intermediate transfer member on which the toner image is transferred. The secondary transfer device 17 secondarily transfers the toner images on the intermediate transfer belt 15 onto the recording medium P and conveys to the fixing device 50. The primary transfer devices 16, the secondary transfer device 17, and the intermediate transfer belt 15 are defined as a transfer unit. In other words, the transfer unit includes the primary transfer devices 16, the secondary transfer device 17, and the intermediate transfer belt 15. The reversing device 21 reverses front and back sides of transfer sheet to transfer the toner image on both sides. The registration rollers 18 register the recording medium P. The manual feed tray 19 is a tray from which the recording medium P is supplied manually. The ejection tray 22 is another tray onto which the recording medium P is ejected. The fixing device 50 fixes the toner image on the recording medium P. A description of the fixing device 50 has already been described with respect to FIG. 1A through FIG. 8B.

The sheet feed unit 200 includes a plurality of sheet cassettes 30 to store a plurality of recording media P.

The scanner 300 includes a contact glass, not shown, a first traveling body, not shown, and a second traveling body, not shown, and reads information such as an image on an original. The automatic document feed device 400 automatically feeds the original thereon to the scanner 300.

As shown in FIG. 9, the copier 100 includes the intermediate transfer belt 15 tightly stretched by a plurality of rollers. The intermediate transfer belt 15 rotates clockwise as indicated by an arrow shown in FIG. 9. The image forming units 10B, 10C, 10M and 10Y are disposed side by side along an upper traveling edge of the intermediate transfer belt 15, thereby forming a tandem image forming system.

The photoconductors 1B, 1C, 1M and 1Y contact the intermediate transfer belt 15. The primary transfer devices 16B, 16C, 16M and 16Y are disposed at an inner surface of the intermediate transfer belt 15. The image forming units 10B, 10C, 10M and 10Y are similar to one another except for toner colors. In other words, the image forming units 10B, 10C, 10M and 10Y respectively include black, cyan, magenta, and yellow toners in the respective developers therein. The exposure device 20 is disposed above the image forming units 10B, 10C, 10M and 10Y, and irradiates the photoconductors 1B, 1C, 1M and 1Y with the scanning light between the respective charging devices and the developers.

The secondary transfer device 17 is disposed below the intermediate transfer belt 15. As shown in FIG. 9, the secondary transfer device 17 is an endless belt tightly stretched by two rollers in such a manner to press against an opposing roller through the intermediate transfer belt 15. The fixing device 50 is disposed on a left side of the secondary transfer device 17 so as to fix the toner image transferred onto the recording medium P. The reversing device 21 is disposed, for example, below the secondary transfer device 17 and the fixing device 50.

A description is now given of an image forming process (e.g., making a copy) by the image forming apparatus 500.

The original to be copied is placed on the automatic document feed device 400. Alternatively, the original can be placed on the contact glass of the scanner 300 by opening the automatic document feed device 400 with respect to the image forming apparatus 500, and can be held by closing the automatic document device 400.

Upon pressing a start switch, not shown, the original placed on the automatic document feed device 400 is automatically transferred to the contact glass so as to be ready by the scanner 300. During an original reading operation by the scanner 300, the first traveling body and the second traveling body begin to travel so that a light source, not shown, emits a light that is reflected from a surface of the original and a mirror, not shown, reflects the light. The reflected light passes through an imaging lens, not shown, and enters a reading sensor, not shown, thereby reading the original.

By contrast, when the original is placed on the scanner 300, the original reading operation begins upon pressing the start switch.

In parallel with the original reading operation, the intermediate transfer belt 15 and the image forming units 10B, 10C, 10M and 10Y begin to drive so that a plurality of single toner images B, C, M and Y are formed on the respective photoconductors 1B, 1C, 1M and 1Y. Each of the single toner images B, C, M and Y is sequentially transferred onto the intermediate transfer belt 15, thereby forming a combined color image thereon.

The sheet feed unit 200 begins a feed operation therewithin at substantially the same time as the beginning of the original reading operation. In the feed operation, one of the sheet cassettes 30 feeds the plurality of recording media P. A sheet separation roller (not shown) separates the plurality of recording media P one by one so that each recording medium P enters separately into a sheet conveyance path, not shown. Subsequently, a sheet conveyance roller, not shown, conveys the recording medium P to the copier 100. The registration rollers 18 halt and register the recording medium P by abutting them. Alternatively, the plurality of recording media P can be fed from the manual feed tray 19 and can be separated one by one so as to be conveyed separately to the registration rollers 18. The conveyance of the recording medium P halts by abutting the registration rollers 18, similar to that of the recording medium P fed from the sheet feed unit 200.

The registration rollers 18 rotate in sync with the combined color image on the intermediate transfer belt 15, thereby feeding the recording media P to a nip between the secondary transfer device 17 and the intermediate transfer belt 15. The secondary transfer device 17 transfers the combined color image on the intermediate transfer belt 15 onto the recording medium P to form a full color toner image thereon.

The secondary transfer device 17 conveys the recording medium P having the full color toner image thereon to the fixing device 50. Subsequently, the fixing device 50 applies heat and pressure to fix the full color toner image on the recording medium P. An ejection roller (not shown) ejecting the recording medium P from the copier 100 is disposed at a latter stage of the fixing device 50 so that the recording medium P is ejected and stacked on the ejection tray 22. Alternatively, the recording medium P can be conveyed to the reversing device 21 by a switching tab (not shown) switching a conveyance direction thereof. The reversing device 21 reverses the front and back sides of the recording medium P and conveys to the fixing device 50, thereby fixing the toner image on the backside thereof. The recording medium P with the full color images on both sides are ejected on the ejection tray 22.

According to the exemplary embodiment, the fixing device 50 includes the separation mechanism 60 employing the non-contact manner. The separation mechanism 60 can obtain separability that is at least substantially the same as that of a separation mechanism employing the contact manner with a separation tab. With the non-contact manner, the separation mechanism 60 can reduce generation of sliding mark, etc. on the toner image, thereby obtaining a high quality image and enhancing the separability thereof. The separation mechanism 60 can also reduce an occurrence of the toner accumulation in the end vicinity of the separation plate 61 and can respond to the surface movement of the fixing member in the course of releasing the pressure, thereby reducing the running cost thereof. The pressure roller 55 can reduce the pressure applied thereby by using the release mechanism to prolong the life-span of the fixing device 50. The fixing device 50 acting as the belt fixing device forms the nip area with the fixing roller 51 having the elastic layer, and can not only provide good fixing ability but can also shorten start-up time, thereby reducing its own power consumption as well as that of the image forming apparatus 500 as a whole.

It should be noted that the exemplary embodiments of the present invention have been described above with reference to FIG. 1A through FIG. 9 but are not limited thereto. Thus, the fixing device 50 may be modified within the scope of the appended claims. For example, the fixing roller 51 and the pressure roller 55 can be modified as appropriate, and the tension of the fixing belt 53 can be optimized. Further, the exemplary embodiments of the present invention can be applied to a fixing device employing a heat roll method that is unlikely to employ a fixing belt. Moreover, although the fixing device 50 employs the halogen heaters 54 and 55 therein, the halogen heaters 54 and 55 can be replaced with induction heaters, for example. The pressing side can include a pressure belt.

According to the exemplary embodiments of the present invention, the image forming apparatus 500 capable of producing the full color image is described. However, the exemplary embodiments can also be applied to an image forming apparatus such as a monochrome image forming apparatus, etc. In addition, the image forming units 10B, 10C, 10M and 10Y can be optionally configured. For example, an image carrier of a full color image forming apparatus can include a plurality of development units in the vicinity thereof. Moreover, the exemplary embodiments can be applied to an image forming apparatus employing a direct transfer method, and are also applicable not only to copiers but also to image forming apparatuses such as printers, facsimiles, and multifunctional devices.

Numerous additional modifications and variation are possible in light of the above teachings. It is therefore to be understood that, within the scope of the appended claims, the disclosure of this patent specification may be practiced otherwise than as specifically described herein.

What is claimed is:

1. A fixing device comprising:

a fixing member;

a pressure member configured to press against the fixing member to form a nip through which a sheet of a recording medium having a toner image is fed to fix the toner image thereon; and a separation mechanism disposed at a downstream side from the nip relative to a sheet feed direction of the sheet of the recording medium to separate the recording medium from the fixing member, the separation mechanism comprising:

a separation plate opposed to the fixing member with a gap therebetween in a sheet feed area and including a metal base member and a resin tip member mounted on a tip of the metal base member; and a gap control member configured to control the gap by contacting the fixing member in a sheet non-feed area and including a curved tip having a radius of not greater than 0.6 mm, wherein a center of the curved tip and a tip of the resin tip member are substantially congruent with each other in a direction perpendicular to the sheet feed direction.

2. The fixing device of claim 1, wherein the metal base member is a sheet metal member and the resin tip member is integrated with the sheet metal member to form the separation plate.

3. The fixing device of claim 2, wherein the metal base member has a tip extended by rolling, and wherein the resin tip member has a tip portion having at least one of a thickness of not greater than 0.2 mm and a curvature of not greater than 0.1 mm.

4. The fixing device of claim 2, wherein the resin tip member is mounted on the sheet metal member by at least one of a swaging manner and an adhering manner and has a tip portion having at least one of a thickness of not greater than 0.2 mm and a curvature of not greater than 0.1 mm.

5. The fixing device of claim 1, wherein the separation mechanism further comprises a roller rotatably held at a downstream side from a tip of the separation plate relative to the sheet feed direction and a guide member configured to guide the recording medium from the tip of the separation plate to the roller.

6. The fixing device of claim 5, wherein the roller and the guide member form a single integrated unit.

7. The fixing device of claim 1, wherein the fixing member comprises a fixing belt and a fixing roller, the fixing roller having an elastic layer configured to press the fixing belt to form the nip.

8. The fixing device of claim 7, wherein the elastic layer comprises foamed material.

9. The fixing device of claim 1, further comprising a release mechanism configured to release pressure from the pressure member.

10. An image forming apparatus comprising:

an image carrier configured to carry a toner image thereon;

a transfer device configured to transfer the toner image onto a recording medium; and a fixing device configured to fix the toner image onto the recording medium, fixing device comprising:

a fixing member;

a pressure member configured to press against the fixing member to form a nip through which a sheet of a recording medium having a toner image is fed to fix the toner image thereon; and a separation mechanism disposed at a downstream side from the nip relative to a sheet feed direction of the sheet of the recording medium to separate the recording medium from the fixing member, the separation mechanism comprising:

a separation plate opposed to the fixing member with a gap therebetween in a sheet feed area and including a metal base member and a resin tip member mounted on a tip of the metal base member; and a gap control member configured to control the gap by contacting the fixing member in a sheet non-feed area and including a curved tip having a radius of not greater than 0.6 mm, wherein a center of the curved tip and a tip of the resin tip member are substantially congruent with each other in a direction perpendicular to the sheet feed direction.

* * * * *